US010043628B2

(12) United States Patent
Steinbauer et al.

(10) Patent No.: US 10,043,628 B2
(45) Date of Patent: Aug. 7, 2018

(54) SWITCHING DEVICE HAVING A DAMPING ELEMENT FOR A CONTACT SYSTEM DURING ABRUPT SWITCHING ON

(71) Applicant: Siemens Aktiengesellschaft, Munich (DE)

(72) Inventors: Martin Steinbauer, Schmidmuehlen (DE); Tobias Kemptner, Fensterbach (DE); Guenter Wiesent, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/303,777

(22) PCT Filed: Jun. 11, 2014

(86) PCT No.: PCT/EP2014/062138
§ 371 (c)(1),
(2) Date: Oct. 13, 2016

(87) PCT Pub. No.: WO2015/188858
PCT Pub. Date: Dec. 17, 2015

(65) Prior Publication Data

US 2017/0032918 A1 Feb. 2, 2017

(51) Int. Cl.
*H01H 3/60* (2006.01)
*H01H 71/50* (2006.01)
(Continued)

(52) U.S. Cl.
CPC ..... *H01H 71/504* (2013.01); *H01H 1/50* (2013.01); *H01H 3/60* (2013.01); *H01H 50/30* (2013.01);
(Continued)

(58) Field of Classification Search
CPC ..... H01H 50/30; H01H 50/305; H01H 1/50; H01H 11/0056; H01H 11/00; H01H 2203/04; H01H 2001/5888; H01H 2203/038; H01H 2203/05; H01H 13/48; H01H 13/52; H01H 1/06; H01H 5/04;
(Continued)

(56) References Cited

U.S. PATENT DOCUMENTS 3,808,389 A * 4/1974 Ramsay ..... G04C 3/001 200/302.2
2003/0094354 A1* 5/2003 Badarneh ..... G06F 3/0338 200/18

FOREIGN PATENT DOCUMENTS

CN 103578867 2/2014
DE 1 015 100 B 9/1957
(Continued)

OTHER PUBLICATIONS

Office Action dated Dec. 12, 2017 which issued in the corresponding Chinese Patent Application No. 201480079719.7.

*Primary Examiner* — Anthony R. Jimenez
(74) *Attorney, Agent, or Firm* — Cozen O'Connor

(57) ABSTRACT

A switching device having a damping element for a contact system during abrupt switching on, wherein the contact system has a contact slide and a switching piece movably guided therein, and the movable switching piece is mounted opposite a fixed switching piece, where the contact slide has at least one projection that is operatively connected to the damping element when the switching device is switched on abruptly.

12 Claims, 3 Drawing Sheets

(51) Int. Cl.
*H01H 1/50* (2006.01)
*H01H 50/30* (2006.01)
*H01H 50/54* (2006.01)

(52) U.S. Cl.
CPC ..... *H01H 50/546* (2013.01); *H01H 2001/508* (2013.01)

(58) Field of Classification Search
CPC ..... H01H 50/546; H01H 1/00; H01H 1/12; H01H 1/20; H01H 1/14; H01H 1/2025; H01H 1/22; H01H 1/36; H01H 3/00; H01H 3/02; H01H 3/32; H01H 3/60; H01H 5/00; H01H 69/00; H01H 71/00; H01H 2221/00; H01H 13/44; H01H 2205/018; H01H 2205/026; H01H 2215/016; H01H 2215/024; H01H 2225/018; H01H 2239/004; H01H 2215/022
USPC ..... 200/5 A, 288, 43.01, 43.16, 43.18, 431, 200/520, 521, 538, 318, 323, 329, 335, 200/341, 345, 301
See application file for complete search history.

(56) References Cited

FOREIGN PATENT DOCUMENTS

| | | | |
|---|---|---|---|
| DE | 1 764 291 | A1 | 5/1971 |
| DE | 2 315456 | A1 | 10/1974 |
| DE | 4 203 803 | A1 | 8/1993 |
| JP | 49-128271 | | 12/1974 |

* cited by examiner

SWITCHING DEVICE HAVING A DAMPING ELEMENT FOR A CONTACT SYSTEM DURING ABRUPT SWITCHING ON

CROSS-REFERENCE TO RELATED APPLICATIONS

This is a U.S. national stage of application No. PCT/EP2014/062138 filed 11 Jun. 2014.

BACKGROUND OF THE INVENTION

1. Field of the Invention

The invention relates to a switching device with a damping element for a contact system during abrupt closing, where the contact system has a contact slide and a switching piece movably guided therein, and where the movable switching piece is mounted opposite a fixed switching piece.

2. Description of the Related Art

Amongst other functions, switching devices, specifically power switches, are used for secure disconnection in case of a short-circuit, thus protecting consumer installations. Electrical or mechanical switching units are also suitable for in-service manual switching of consuming devices, and for secure isolation of an installation from a power grid in the event of maintenance works or modifications to the installation. In many cases, electric switching units are electromagnetically operated.

This means that switching units of this type are technically high-grade electric switching devices with integrated protection for motors, lines, transformers and generators. More specifically, these are used in functional locations with a low switching frequency. In addition to short-circuit protection, such switching units are also suitable for overload protection.

In case of a short-circuit, an electric switching unit securely disconnects an electrical installation. Overload protection is provided accordingly. Each conductor in which a current flows heats up to a greater or lesser extent. Heat-up is dependent upon the ratio of the current strength to the conductor cross section, or "current density". The current density must not become too high, because excessive heat-up can otherwise cause the smearing of conductor insulations, with a consequent risk of switching units are used as overcurrent protection devices.

Power switches are provided with two separately-operated trip mechanisms for overload and short-circuit protection. Both trip devices are connected in series. Short-circuit protection is assumed by a virtually instantaneously acting electromagnetic trip device. In case of a short-circuit, the electromagnetic trip device immediately disengages a breaker mechanism on the power switch. A switching rotor separates the switching piece before the short-circuit current can achieve its maximum value.

Conventional switching units have a contact slide unit with a contact slide and a movable switching piece. The movable switching piece is also provided with electrical contacts. Switching units of this type also have first switching contacts to a conductor. In a switched-on state, the electrical contacts on the movable switching piece engage with the fixed contacts on the switching unit. In case of a short-circuit, the electrical contacts on the movable switching piece are disengaged from the fixed contacts, such that the flow of current is interrupted. To this end, the movable switching piece is disengaged from the fixed contacts.

In addition to their protective functions as overload and short-circuit trip devices, as described above, power switches are also responsible for the standard switching on and switching off of motors. In order to demonstrate this function, the power switch, in accordance with product standards, must be capable of closing ten times the rated motor current. In order to be able to guarantee the accommodation of this critical load, it is necessary for the power switch to close the double break in the three current paths, formed respectively by a movable bridge with two movable contact points and two fixed contact points, virtually simultaneously and by a snap-on action.

For execution of this function, via a manually-operated mechanism comprising an actuator, a breaker mechanism and an actuating train, the contact system comprised of the contact slide and a movable bridge is released. This release is effected via "rapid closing", whereby the term "rapid" refers here to abrupt or spontaneous closing. By this arrangement, the three contact systems are only released by a mechanism after the breaker mechanism has already been closed. The stored-energy spring, in the form of a contact load spring, dictates the kinematics of the contact during closing.

By the impact of the bridge against the fixed switching pieces, the contact slide is accelerated, and thus rebounds against a limit stop. This rebounding, and the resulting kinetic energy of the contact slide, results in the re-opening of the contact system. With the presence of a simultaneously increased current on this current path, fusion may result.

SUMMARY OF THE INVENTION

In view of the foregoing, it is accordingly an, object of the present invention to provide a switching device with a contact system which, upon the abrupt closing of the switching device, prevents the rebounding of the contacts.

This and other objects and advantages are achieved in accordance with the invention by a switching device with a damping element for the contact system during abrupt closing, where the contact system has a contact slide and a switching piece movably guided therein, and where the movable switching piece is mounted opposite a fixed switching piece. In accordance with the invention, the contact slide has at least one projection which, upon the abrupt closing of the switching device, engages with the damping element.

On the grounds of the high rated current of $I_N$=80 A, and the fact that standards dictate that it must be possible to close ten times the rated motor current, it is necessary for the closing dynamics of the switch to equate as closely as possible to a snap-on function. The principle of rapid closing is based upon the fact that the closing motion of the contact system, comprised of a contact slide, a bridge and a fixed switching piece, is tripped by the closing motion of the operating lever, and is thus under the overriding control of the manually-actuated mechanism comprised of the actuator, the breaker mechanism and the transmission train. During the closing process, the contact system, and consequently the bridge, is maintained at a certain distance from the fixed switching pieces by the operating lever, until the overriding manually-actuated mechanism has completed the closing process. Only then will the contact system be released, whereby the contacts are closed by the pre-tensioned stored-energy spring, in a snap-on action.

On the grounds of the strong forces of the contact load spring, which are dictated by the high rating of the device, the contact slide continues to accelerate after the contacts are closed. The contact slide collides with the operating lever, rebounds from the operating lever and, upon colliding with the bridge, re-opens the contacts, thus resulting in the fusion of the contacts and the failure of the device.

In accordance with the invention, this problem is resolved by a damping element, which is part of the holder sub-assembly. The function of this damping element is to absorb the kinetic energy of the contact slide after the abrupt closing of the device, thus preventing the rebounding of the contact slide, and consequently the re-opening of the contacts.

The damping element in accordance with the invention is preferably configured as a stamped-bent part and, in the present structure, is employed as a catch spring. The catch spring is integrally mounted to the holder sub-assembly, below a baffle. The catch spring is provided with V-shaped leaf spring elements which, in the mounted state, positively enclose the contact slide, which is provided with trapezoidal thickenings. If the contact slide lies between the two "on" and "off" positions, the catch spring is inactive, and the freedom of movement of the contact slide is unrestricted. However, if the inertia of the contact slide causes its further upward movement following a rapid closing process, such that it disengages from the bridge, it will be effectively arrested in its upward movement by the catch spring. Rebounding from the operating lever is thus no longer possible. Accordingly, the contacts cannot be re-opened, such that any fusion, and ultimately the destruction of the device, is prevented.

By the catch spring in accordance with the invention, which is provided with V-shaped leaf spring elements, and a trapezoidal thickening as a mating component on the contact slide, the contact slide is effectively arrested, if its upward acceleration by inertia continues after a closing operation. The use of the catch spring in accordance with the invention prevents the rebounding of the contact slide from the operating lever associated with its kinetic energy, and the re-opening of the contacts during its reverse motion. The risk of the consequent fusion of the contacts, and the destruction of the device, no longer arises.

The damping element in accordance with invention has a further advantage, in that no deviation from customary installation procedures is required, because the missing catch spring elements can simply be bridged upon the installation of the contact slide. During normal operation, i.e., between the "on" and "off" state of the switching device, the catch spring has no impact upon the freedom of movement of the contact slide. Only where the contact slide disengages from the bridge is it effectively arrested by the catch spring, in order to prevent rebounding.

In a particularly advantageous embodiment of the invention, the contact slide may be configured in a U-shaped manner, with a center piece and two lateral guides, on which at least one projection is arranged. The projection is preferably a trapezoidal thickening on one lateral guide of the contact slide, configured as a mating component for a recess in the damping element such that, upon the abrupt closing of the switching device, the contact slide is effectively arrested in its upward movement. Accordingly, rebounding from the operating lever of the switching device is no longer possible. Consequently, the contacts in the contact system can no longer be opened, such that any fusion is prevented.

In a further embodiment in accordance with the invention, the damping element is configured as a stamped-bent part. The configuration of the damping element as a stamped-bent part has an advantage, in that the damping element can be produced simply and cost-effectively, and is also easy to install.

In a special embodiment of the invention, the damping element is configured in a U-shaped manner, with two parallel and mutually-spaced lateral segments and a bridging piece. The configuration of the damping element in accordance with the invention with a U-shape has the advantage, in that the damping element can be positioned around the baffle of the switching device, which is generally located on the housing base of the switching device. This permits the secure attachment of the damping element in the sub-assembly of the switching device. In accordance with the invention, the baffle is arranged on the bridging piece of the damping element.

In a further embodiment in accordance with the invention, the lateral segments of the damping element are provided with recesses which, upon the abrupt closing of the switching device, engage with the at least one projection on the contact slide. If the contact slide lies between the two "on" and "off" positions, the damping element is inactive, and the freedom of movement of the contact slide is unrestricted. However, if the inertia of the contact slide causes its further upward movement following a rapid closing process, such that it disengages from the bridge, the damping element will be effectively arrested in its upward movement as a result of the cooperation of the projection on the contact slide with the recess in the damping element. Rebounding from the operating lever is thus no longer possible.

In a particularly preferred embodiment of the invention, a further technical development in accordance with the invention is provided, in that the damping element is positioned below a baffle of the switching device. The baffle of a switching device, specifically of a power switch, is generally positioned on the housing base. As a result of the U-shaped configuration of the damping element, the baffle can be routed through the two parallel and mutually-spaced lateral segments of the damping element to rest on the bridging piece of the damping element. This arrangement ensures the secure attachment of the damping element to the holder sub-assembly of the switching device.

In accordance with another embodiment of the invention, the damping element is configured as a leaf spring element. This special form of embodiment of the damping element has an advantage, in that this type of spring element does not require a particularly large amount of space. In this special form of embodiment, it is possible for the damping element to positively enclose the contact slide, with its trapezoidal thickenings, in the mounted state.

In accordance with another embodiment of the invention, in the mounted state, the contact slide is positively enclosed by the damping element. A damping element configured as a leaf spring element is particularly conducive to this specific exemplary embodiment.

In yet a further embodiment of the invention, the switching device is a power switch.

The switching device in accordance with exemplary embodiments of the invention is enclosed by a housing, and is provided with a contact system with a contact slide, into which a movable switching piece with contacts is guided, and a fixed switching piece mounted opposite the movable switching piece. The contact slide is preferably configured in a U-shaped manner, with a center piece and two lateral guides. A contact load spring is arranged between the lateral guides of the contact slide. Above the center piece of the contact slide, an operating lever is arranged, which cooperates with the contact system. The principle of rapid closing is based upon the fact that the closing motion of the contact system, comprised of a contact slide and fixed and movable switching pieces, is tripped by the closing motion of the operating lever, and is thus under the overriding control of the manually-actuated mechanism comprised of the actuator, the breaker mechanism and the transmission train. During the closing process, the contact system, and consequently the bridge, is maintained at a certain distance from the fixed switching pieces by the operating lever, until the overriding manually-actuated mechanism has completed the closing process. Only then will the contact system be released, whereby the contacts are closed by the pre-tensioned stored-energy spring, in a type of snap-on action.

The contact load spring is arranged on a baffle, which is positioned on the housing base of the switching device. The contact slide, the contact load spring, which is positioned between the lateral guides of the contact slide, and the baffle are enclosed by a damping element, which is preferably configured as a leaf spring element or as a catch spring, such that the damping element rests on a lateral guide of the contact slide and is routed below the baffle.

The switching device in accordance with disclosed embodiments of the invention with a damping element for the contact system is characterized in that the use of the damping element prevents the rebounding of the contact slide from the operating lever associated with its kinetic energy, and the re-opening of the contacts during its reverse motion. The risk of fusion of the contacts, and the consequent destruction of the device, no longer arises. A further advantage is provided, in that no deviation from customary installation procedures is required, as the spring element can simply be bridged upon the installation of the contact slide. During normal operation, i.e., between the "on" and "off" state of the device, the damping element has no impact upon the freedom of movement of the contact slide. Only where the contact slide disengages from the bridge is it effectively arrested by the catch spring, in order to prevent rebounding.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further advantages and embodiments of the invention are described in greater detail hereinafter with reference to exemplary embodiments, and with reference to the drawing, in which.

DETAILED DESCRIPTION OF THE EXEMPLARY EMBODIMENTS

Figure 1:
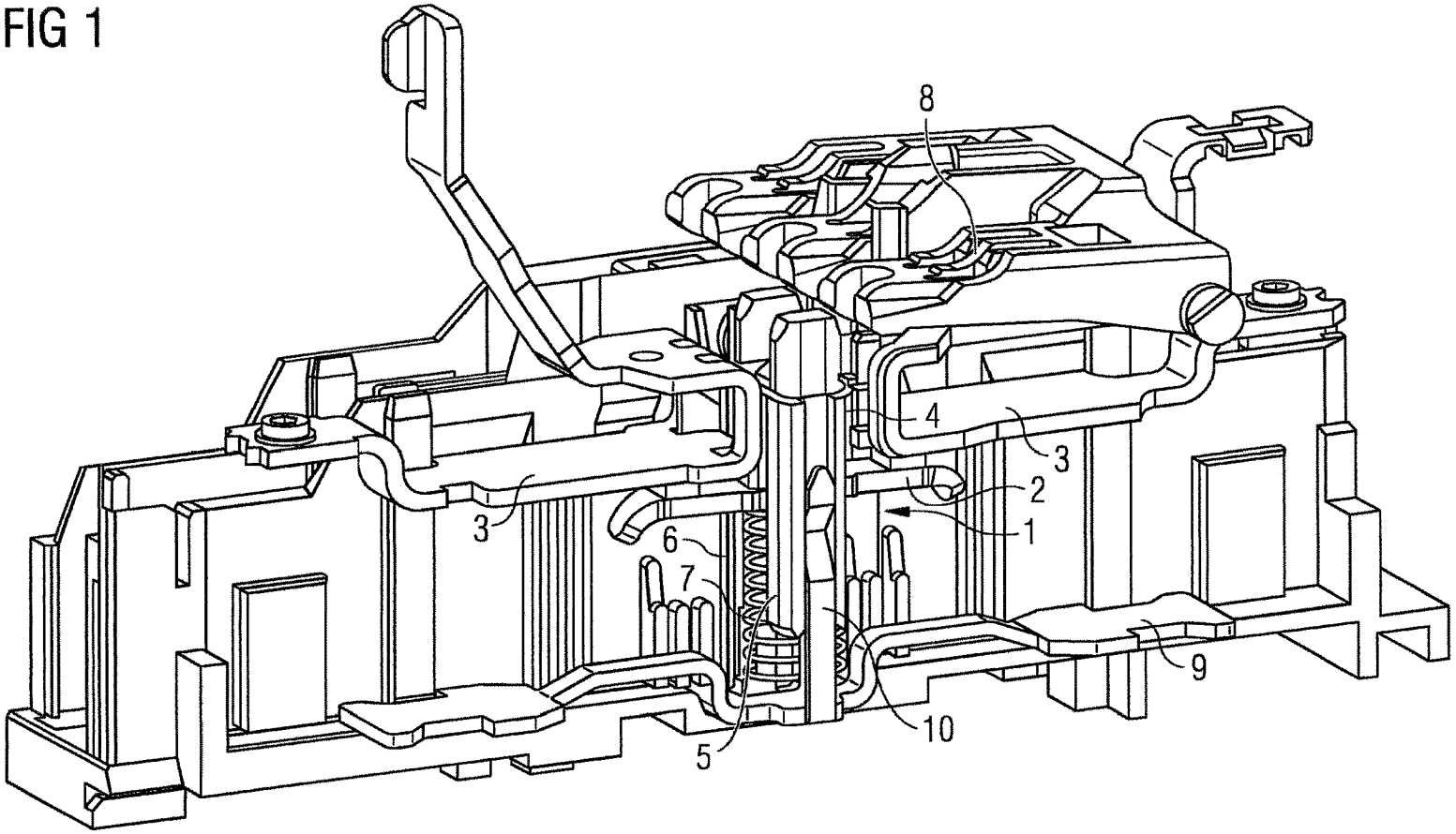
FIG. 1 shows a perspective view of a partial section of a switching device in accordance with the invention, with a contact system and a damping element.

FIG. 1 shows a switching device in accordance with the invention the invention, which is enclosed by a housing and has a contact system, comprising a contact slide 1, into which a movable switching piece 2 with contacts is guided, and a fixed switching piece 3 mounted opposite the movable switching piece 2. The contact slide 1 is preferably configured in a U-shaped manner, with a center piece 4 and two lateral guides 5, 6. A contact load spring 7 is arranged between the lateral guides 5, 6 of the contact slide 1. Above the center piece 4 of the contact slide 1, an operating lever 8 is arranged, which cooperates with the contact system.

The principle of rapid closing is based upon the fact that the closing motion of the contact system, comprised of a contact slide 1, a movable switching piece 2 and a fixed switching piece 3, is tripped by the closing motion of the operating lever 8, and is thus under the overriding control of the manually-actuated mechanism comprised of the actuator, the breaker mechanism and the transmission train. During the closing process, the movable switching piece 2 is maintained at a certain distance from the fixed switching pieces 3 by the operating lever 8, until the overriding manually-actuated mechanism has completed the closing process. Only then will the contact system be released, whereby the contacts are closed by the pre-tensioned stored-energy spring, in a type of snap-on action.

The contact load spring 7 is mounted on a plastic dome in the lower part of the switching device. A baffle 9 is positioned on the housing base. The contact slide 1, the contact load spring 7 which is positioned between the lateral guides 5, 6 of the contact slide 1, and the baffle 9, are enclosed by a damping element 10, which is preferably configured as a leaf spring element or as a catch spring, such that the damping element 10 rests on the lateral guides 5, 6 of the contact slide 1 and is routed below the baffle 9.

Figure 2:
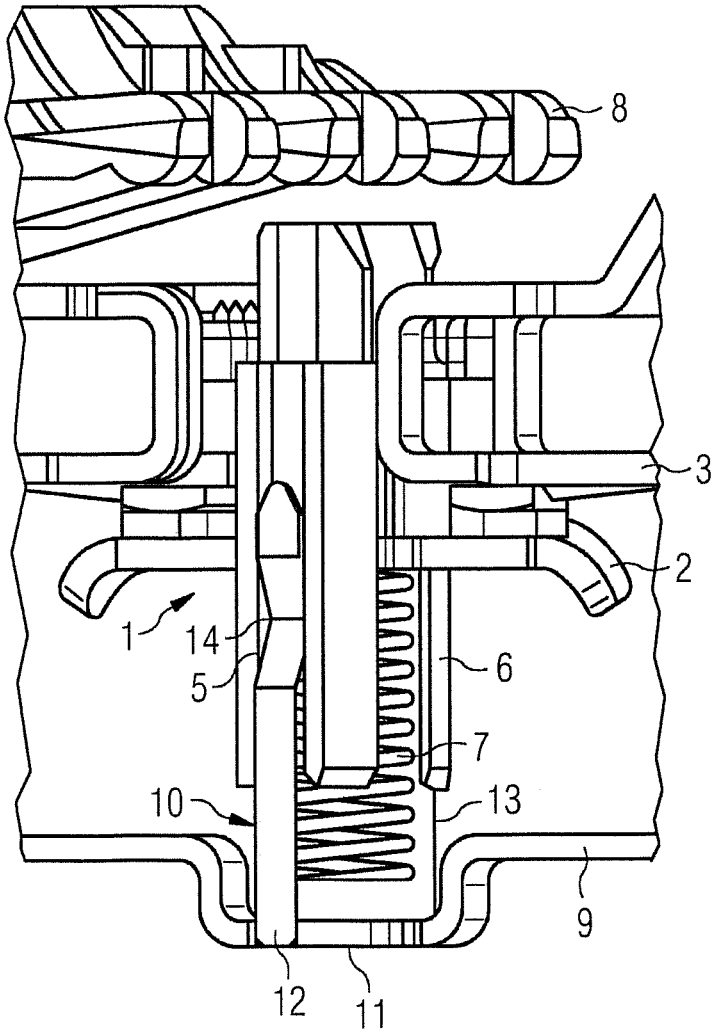
FIG. 2 shows a perspective view of the contact system with its damping element in accordance with the invention.

FIG. 2 illustrates how the damping element 10 encloses the unit comprised of the contact slide 1, the contact load spring 7 and the baffle 9. The damping element 10 is preferably configured in a U-shape, with a bridging piece 11 and two parallel and mutually-spaced lateral segments 12, 13. The lateral segment 12 of the damping element 10 rests on the lateral guide 5 of the contact slide 1. The lateral segment 13 of the damping element 10 likewise rests on the lateral guide 6 of the contact slide 1. The baffle 9 is positioned on the bridging piece 11 of the damping element 10, and passes between the lateral segments 12, 13 such that the damping element 10 encloses the lateral guides 4, 5 of the contact slide, the contact load spring 7 positioned between the latter, and the baffle 9. FIG. 2 also shows be seen that the lateral segments 12, 13 of the damping element 10 are provided with recesses 14, which are configured to engage with the lateral guides 5, 6 of the contact slide 1.

Figure 3:
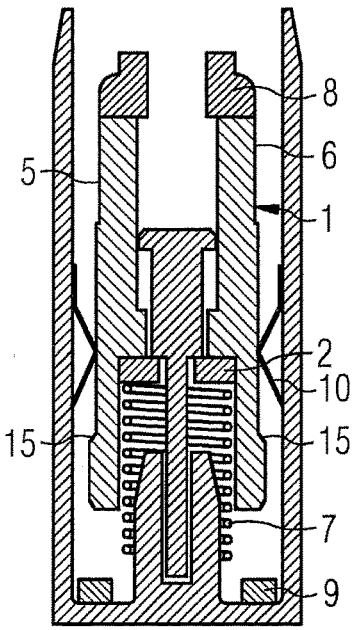
FIG. 3 shows a cross-sectional view of the contact system with its damping element, in the disconnected state in accordance with the invention.

FIG. 3 shows the contact system in accordance with the invention, with the damping element in the disconnected state. In the disconnected state, the contacts are open and the operating lever 8 rests on the contact slide 1. In this switching state, the damping element 10 is inactive. In FIG. 3, projections 15 are represented, which are arranged at the ends of the lateral guides 5, 6 of the contact slide 1. After rapid closing, these projections 15 cooperate with the recesses 14 in the damping element 10.

Figure 4:
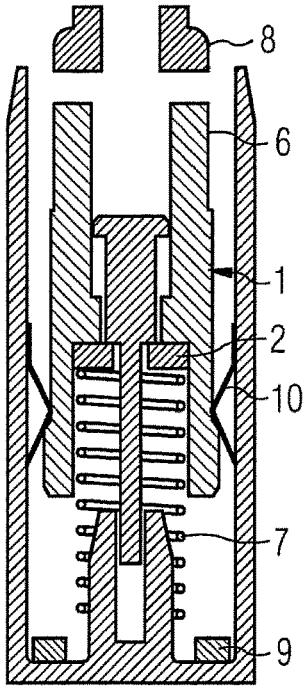
FIG. 4 shows a cross-sectional view of the contact system with its damping element, in the closed position in accordance with the invention.

FIG. 4 shows the contact system in accordance with the invention, with the damping element 10 in the closed state. In the closed state, the operating lever 8 is not directly in contact with the contact slide 1. In this switching state, the contacts on the movable switching piece 2 and the fixed switching piece 3 are closed. Here, again, the damping element 10 is inactive.

Figure 5:
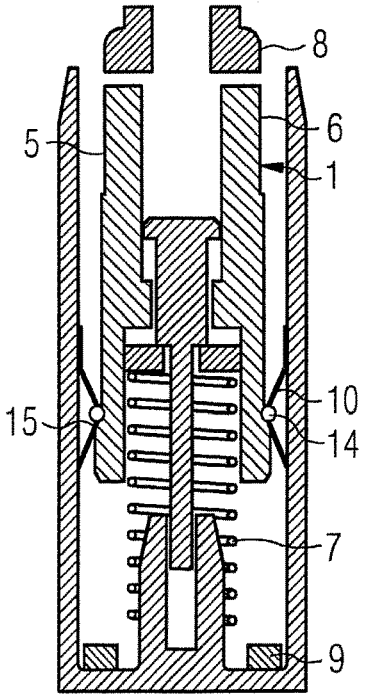
FIG. 5 shows a cross-sectional view of the contact system with its damping element, after abrupt closing in accordance with the invention.

FIG. 5 shows the contact system in accordance with the invention with the damping element 10, following abrupt closing. In this case, the contacts remain closed. The contact slide 1 attempts to accelerate, but is arrested by the damping element 10. The arresting process is achieved by the cooperation of the projections 15 on the lateral guides 5, 6 of the contact slide 1 with the recess 14 on the lateral segments 12, 13 of the damping element 10. The damping element 10 is preferably configured as a catch spring, and forms the mating component for a preferably trapezoidal thickening on the contact slide. The movement of the contact slide 1 is thus effectively arrested. The use of this damping element 10 prevents the rebounding of the contact slide 1 from the operating lever 8 associated with its kinetic energy, and the re-opening of the contacts during its reverse motion. The risk of the fusion of the contacts, and the consequent destruction of the device, no longer arises.

The switching device in accordance with the invention with a damping element for the contact system is characterized in that the use of the damping element prevents the rebounding of the contact slide from the operating lever associated with its kinetic energy, and the re-opening of the contacts during its reverse motion. The risk of fusion of the contacts, and the consequent destruction of the device, no longer arises. A further advantage is provided, in that no deviation from customary installation procedures is required, as the spring element can simply be bridged upon the installation of the contact slide. During normal operation, i.e., between the "on" and "off" state of the device, the damping element has no impact upon the freedom of movement of the contact slide. Only where the contact slide disengages from the bridge is it effectively arrested by the catch spring, in order to prevent rebounding.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those element which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A switching device comprising:

a fixed switching piece;

a damping element for a contact system during abrupt closing, the contact system including:

a contact slide including at least one projection which, upon the abrupt closing of the switching device, engages with the damping element at a radially external position of the contact slide; and a movable switching piece movably guided within the contact slide at the entirety of its center piece and mounted opposite the fixed switching piece.

2. The switching device as claimed in claim 1, further comprising:

a baffle;

wherein the damping element is positioned below the baffle.

3. The switching device as claimed in claim 1, wherein the damping element is configured as a leaf spring element.

4. The switching device as claimed in claim 1, wherein, in the mounted state, the contact slide is enclosed by the damping element.

5. The switching device as claimed in claim 1, wherein the switching device is a power switch.

6. The switching device as claimed in claim 1, wherein the contact slide has a U-shaped configuration, with the center piece and two lateral guides, upon which the at least one projection is arranged.

7. The switching device as claimed in claim 6, wherein the damping element is a stamped-bent part.

8. The switching device as claimed in claim 6, wherein the damping element has a U-shaped configuration, with two parallel and mutually-spaced apart lateral segments and a bridging piece.

9. The switching device as claimed in claim 1, wherein the damping element is a stamped-bent part.

10. The switching device as claimed in claim 9, wherein the damping element has a U-shaped configuration, with two parallel and mutually-spaced apart lateral segments and a bridging piece.

11. The switching device as claimed in claim 1, wherein the damping element has a U-shaped configuration, with two parallel and mutually-spaced apart lateral segments and a bridging piece.

12. The switching device as claimed in claim 11, wherein the lateral segments of the damping element include recesses which, upon the abrupt closing of the switching device, engage with the at least one projection on the contact slide.

* * * * *